United States Patent [19]

Mantegani

[11] 4,249,895

[45] Feb. 10, 1981

[54] KILN

[75] Inventor: Enzo Mantegani, Milan, Italy

[73] Assignee: Welko Industriale S.p.A., Milan, Italy

[21] Appl. No.: 947,176

[22] Filed: Sep. 29, 1978

[30] Foreign Application Priority Data

Oct. 7, 1977 [IT] Italy ..... 28368 A/77
Jul. 10, 1978 [IT] Italy ..... 25488 A/78

[51] Int. Cl.[3] ..... F27B 9/02

[52] U.S. Cl. ..... 432/128; 432/133; 432/145; 432/78

[58] Field of Search ..... 432/72, 78, 128, 130, 432/133, 136, 143–146, 152, 155, 176, 187

[56] References Cited

U.S. PATENT DOCUMENTS

| | | | |
|---|---|---|---|
| 2,750,680 | 6/1956 | Houdry et al. | 432/72 |
| 2,981,528 | 4/1961 | Culp | 432/145 |
| 3,172,647 | 3/1965 | Remmey | 432/145 |
| 3,540,703 | 11/1970 | Kozmin et al. | 432/133 |
| 3,787,171 | 1/1974 | Cromp | 432/72 |
| 3,869,249 | 3/1975 | Frische | 432/133 |
| 3,923,449 | 12/1975 | Brock | 432/128 |
| 4,011,041 | 3/1977 | Taylor | 432/176 |
| 4,014,642 | 3/1977 | Helming | 432/78 |
| 4,060,914 | 12/1977 | Hoffman | 98/40 C |
| 4,140,467 | 2/1979 | Ellison et al. | 432/72 |
| 4,174,951 | 11/1979 | Bloom | 432/222 |

*Primary Examiner*—Henry C. Yuen
*Attorney, Agent, or Firm*—Michael J. Striker

[57] ABSTRACT

A kiln includes a hollow elongated housing which has an inlet and an outlet spaced from each other defining between them the interior of the housing designed to receive through the inlet the items to be treated. The housing includes a number of sections operative for treating the items as they gradually pass through the sections towards the outlet with different respective treating regimes. The sections downstream of the housing are interconnected with the section upstream of the housing so as to recover the heated gas from the downstream sections and supply the same into the upstream section in predetermined quantities and at a predetermined temperature.

6 Claims, 7 Drawing Figures

KILN

BACKGROUND OF THE INVENTION

The present invention relates to kilns for baking items for example of ceramic or refractory material.

More particularly the invention concerns arrangements for controlling the temperature within the kilns, for example roller kilns.

It is known in the prior art to provide a roller kiln with a transport path for the items to be treated. This path may be constituted by a plurality of rotatable rollers extending transversely relative to the length of the kiln. The items transported through the kiln are subjected to different treating regimes in different treating sections of the kiln. Such sections may include one (or more) preheating and degassing sections, one (or more) baking sections, a forced cooling section, a natural cooling section, etc.

It has been recognized that conventional kilns do not make it possible to change, namely to increase the speed of at least some treatment steps. It is to be understood that such a shortcoming results in unduly slow transportation of the items to be treated in the kiln or a greater than otherwise necessary length for the kiln, which in turn increases the cost of the kiln.

SUMMARY OF THE INVENTION

It is a general object of the present invention to overcome the shortcomings of prior art kilns.

More particularly, it is an object of the present invention to provide a kiln with an arrangement which would render it possible to regulate the various treatment steps, that is to adjust the different steps to different treating regimes depending upon the particular kind of items to be treated thus increasing the productivity of the kiln.

In pursuance of these objects and others which will become apparent hereafter, one feature of the present invention resides in providing a hollow elongated housing having an inlet and an outlet spaced from each other defining between them the interior of the housing designed to receive through said inlet the items to be treated. The housing includes at least one heating section and one cooling section located downstream relative to said heating section and serving to cool the items to be treated after the latter have left the heating section. There are provided first means for feeding a first medium into said cooling section for cooling the hot items exiting from the heating section. The first medium becomes heated as a result of contact with the hot items. The thus heated medium is withdrawn from the interior of the housing downstream of said cooling section. There are provided second feeding means for feeding at least a portion of the thusly withdrawn heated medium back into a predetermined part of the interior of the housing (for example upstream of said cooling section into a preheating section).

The rest of the withdrawn heated medium is discharged to the atmosphere. It is to be mentioned that the portion of the heated medium which is fed back into the interior of the kiln can be varied in accordance with the desired temperature regime in the preheating section. The heated medium is supplied through a number of burners located upstream of said cooling section and spaced one from another. Before being fed into the interior of the housing the heated medium is mixed with a portion of fresh air in quantities.

The housing is provided with a prekiln located before the inlet of the housing. Another advantageous feature of the present invention resides in providing means for withdrawing hot gas somewhere along the length of the kiln (preferably from a preheating section) and supplying the thus withdrawn hot gas into the prekiln. Usually, this preheating section is designed to remove vapors and gases from the items to be treated. The prekiln serves for preliminary heating of the items before they enter the preheating section of the kiln.

The cooling means advantageously include a blower for supplying the medium and conduits connecting the blower with the interior of the cooling section. The conduits (preferably two: one above and one below the transport path) are provided with nozzles extending along the length of the cooling section and open onto the transport path so as to direct the medium onto the items to be cooled as they pass through the cooling section. Another advantageous feature of the present invention is that the conduits are adapted to rotate around their respective axes so as to vary the direction of the supplied medium onto the items to be treated in accordance with the desired cooling speed and the material of the items to be treated.

The kiln in accordance with the present invention is further provided with means for controlling and adjusting the flow of the medium to be fed back into the upstream sections of the kiln.

It is to be mentioned, that in prior-art fueled or electrically heated kilns, the heated gas created in the baking section is permitted to flow in the direction opposite to the direction of advancement of the items. This can create very serious disadvantages, for example affecting the temperature regime in the preheating section. This fact, results in unduly and uncontrollabe increases in the temperature of the preheating section. However, it is to be understood that the desired result, that is separating the items to be treated from gaseous residues (whether originally present or generated by organic impurities) can be obtained if the items are heated relatively slowly, that is in accordance with a predetermined regime. Usually, the highest permitted temperature for this regime is somewhere around 700° C., that is the temperature above which there will start to form a gasproof film which will prevent any separation of the gases from the items.

To avoid this undesired influence, it was a common practice with prior-art kilns to introduce into the preheating section a considerable quantity of ambient air. It has been recognized, however, that such a technique is not satisfactory with respect to the requirement for effective control of the temperature in the preheating section. Besides that, such a solution leads to the wasting of almost 50% of the total heat supplied into the kiln, which considerably increases the cost of operation of such a kiln. In order to eliminate this disadvantage of prior art kilns, the present invention teaches means for withdrawing the heated gas from the portions at the downstream part of the kiln and at least partially feeding said withdrawn hot gas back into the predetermined sections of the kiln (preferably at an upstream part of the transport path).

This feature makes it possible to considerably decrease the fuel or electric power consumption of the kiln and to reduce the length of the preheating section, which is normally the longest of the sections of the kiln, which in turn makes it possible to further decrease the cost of the kiln and its maintenance.

In the preferred embodiment of the present invention, the hot gas withdrawn from the baking section is enriched with the hot gas withdrawn from the cooling sections so as to naturally decrease the temperature of the thus created hot gas mixture before supplying such a mixture into the interior of the preheating section.

It is to be mentioned that this arrangement is operative independently or in combination with any other forced cooling equipment mounted on the kiln.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
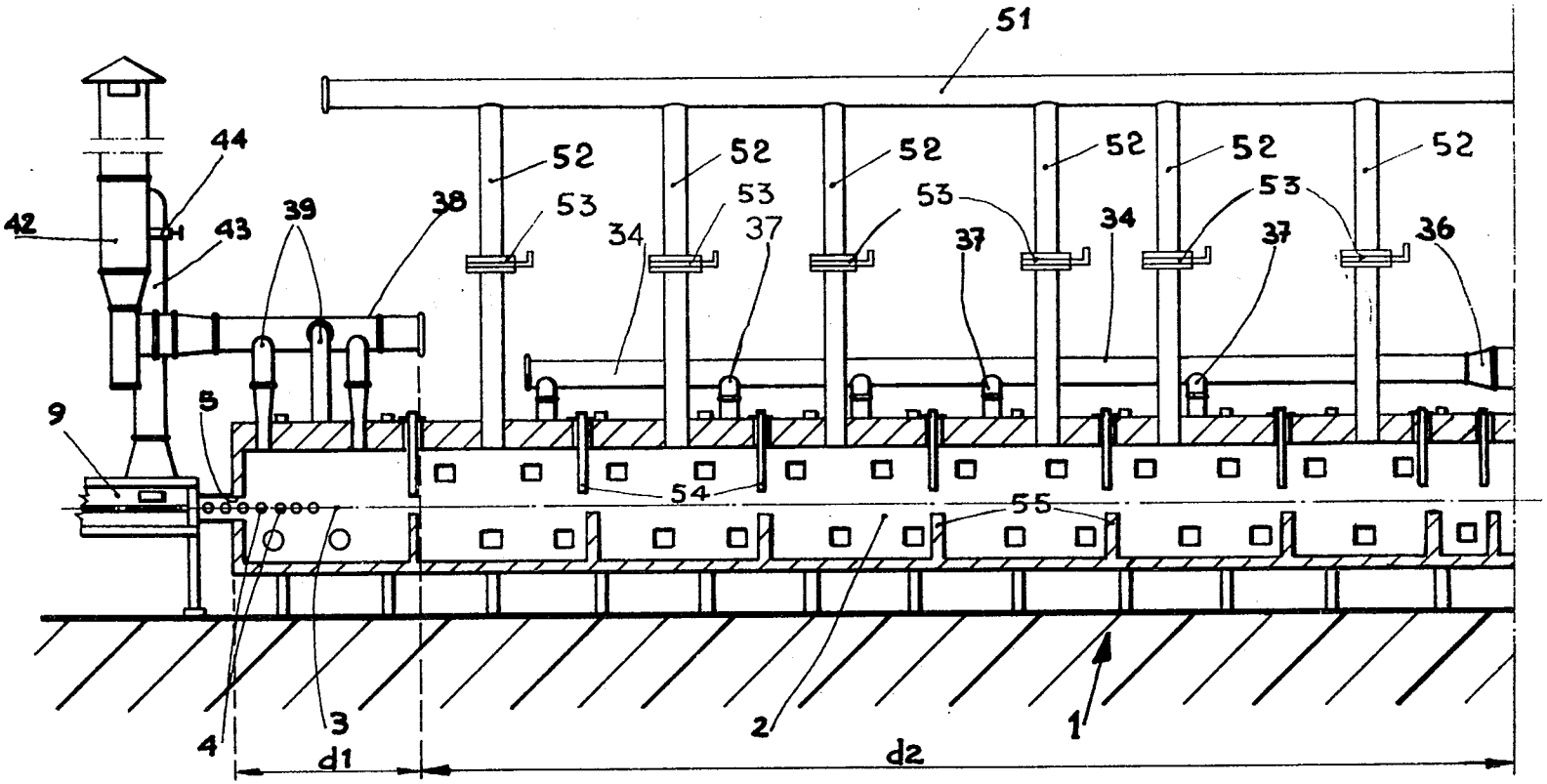
FIGS. 1, 2 and 3 are longitudinal sectional views of the successive portions of a kiln in accordance with the present invention.
Figure 2:
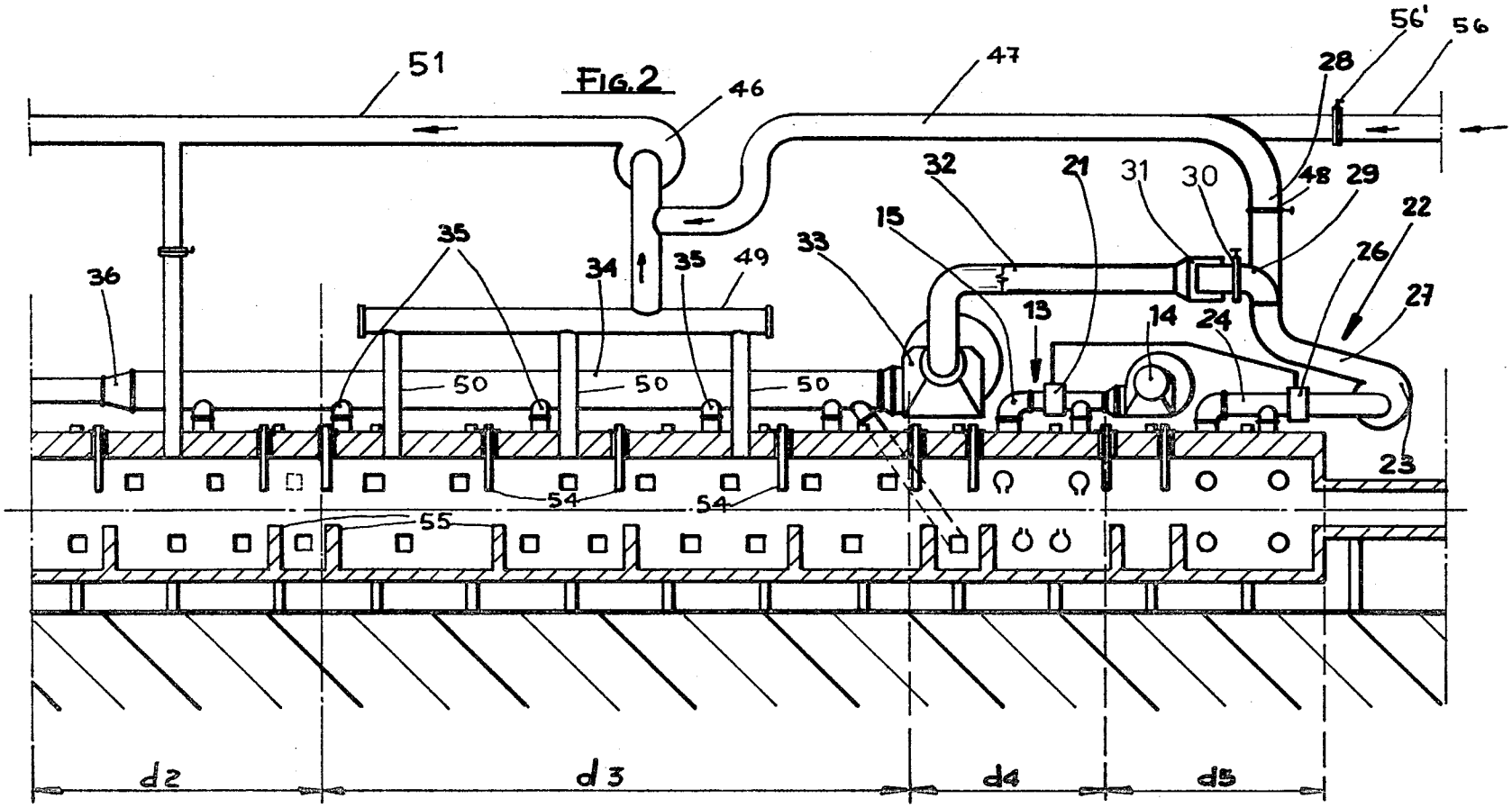
Figure 3:
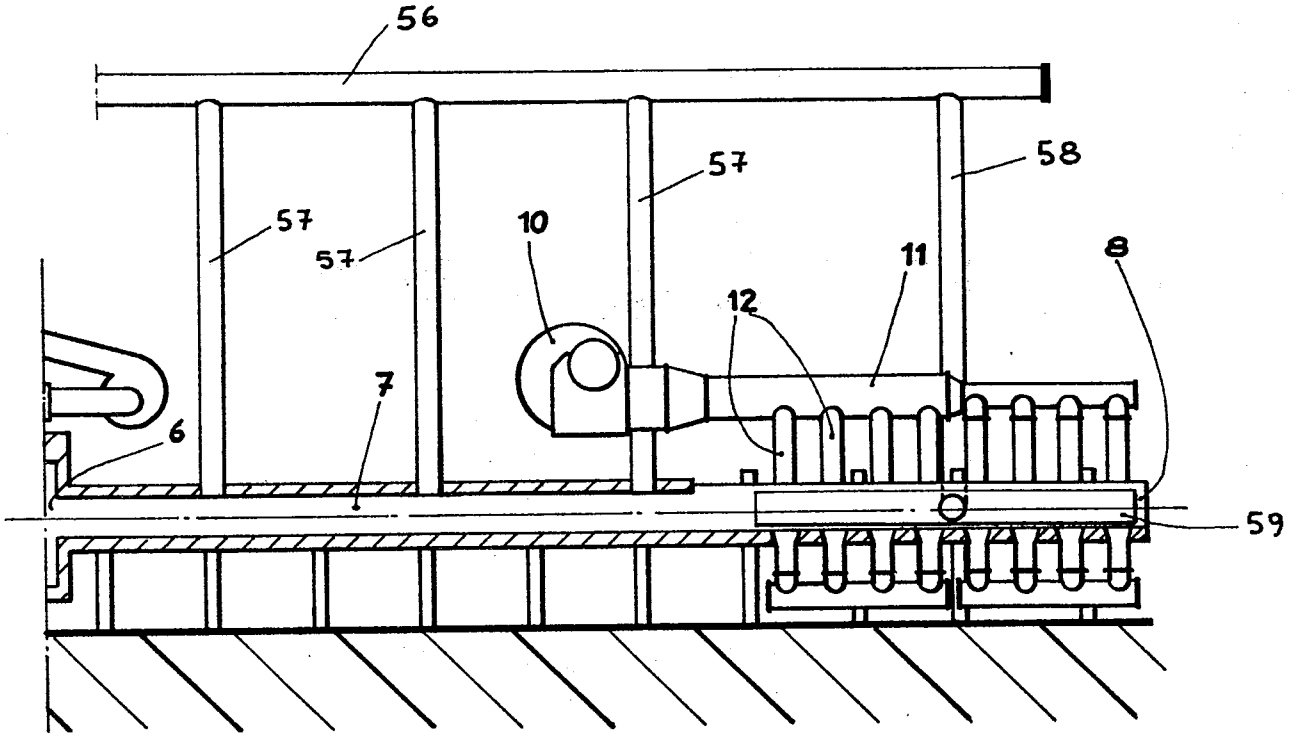

Referring now to the drawings and first to FIGS. 1, 2 and 3 thereof, reference numeral 1 designates a roller kiln having a tunnel 2 with a transport path 3 for the items to be treated. The items are transported by a plurality of refractory rollers 4 extending horizontally and transversely relative to the length of the transport path 3. The rollers 4 are individually driven.

The items to be treated are introduced through an inlet 5 and are withdrawn from the kiln 1 through the outlet 8 of a natural cooling section 7.

The kiln 1 is subdivided into a number of successive sections, each of them operating with a different respective treating regime.

The sections includes: a short initial section d-1 wherein the hot gas is withdrawn and supplied in a direction opposite to that of the transport of the items; a second section d-2 wherein the items are preheated in order to degas the same from the vapor and smoke originating from the organic residues contained in the material of the items; a third section d-3 where the material is subjected to baking. In the section d-3 the temperature is raised as fast as possible and then maintained at a level sufficient to bake the material of the items.

In a fourth section d-4 the items are subjected to a forced cooling. The hot air is withdrawn from the interior of the kiln 1 downstream of the cooling section d-4 in a fifth section d-5. The items are then transported through the tunnel 7 where they are subjected to natural cooling. In the end of the tunnel 7 there is provided a compressor 10 for supplying cooling air to effect further forced cooling of the items. The air is blown into the interior of the housing from above and below the items.

Figure 4:
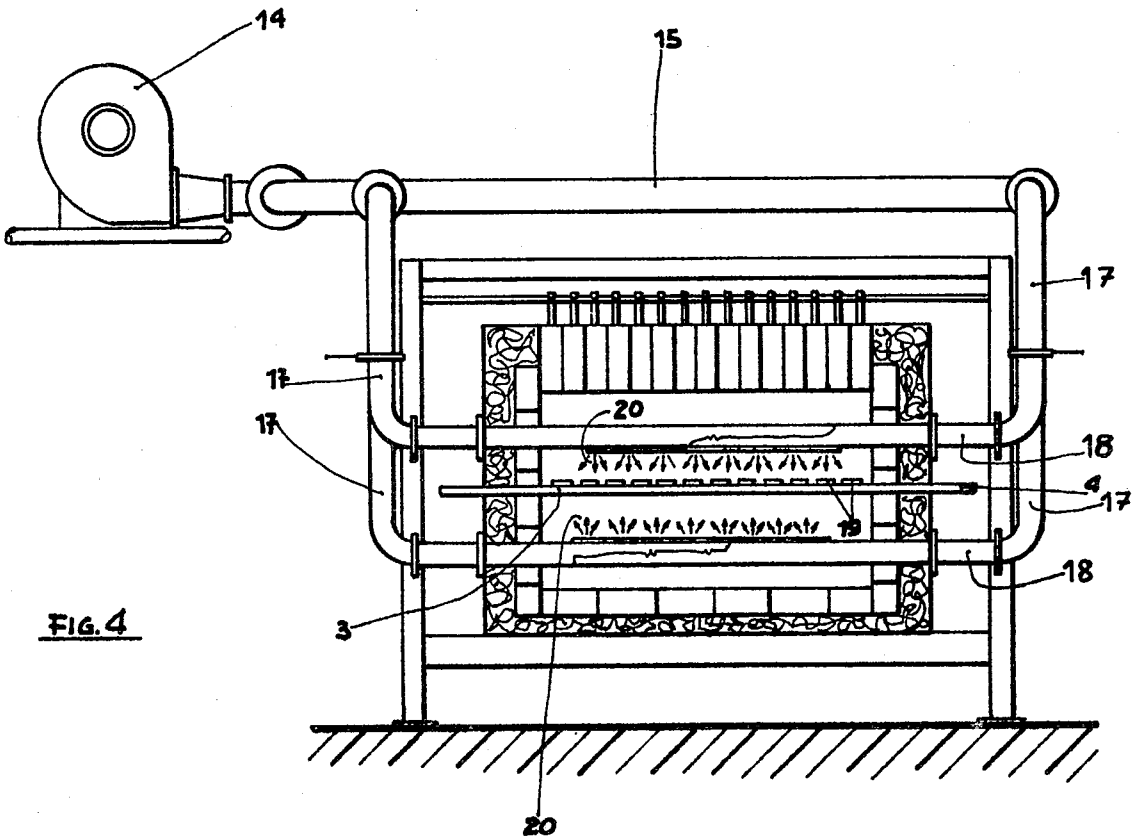
FIGS. 4 and 5 are different views of a cooling device for the kiln; and, FIGS. 6 and 7 are different views of a withdrawing device for the kiln.
Figure 5:
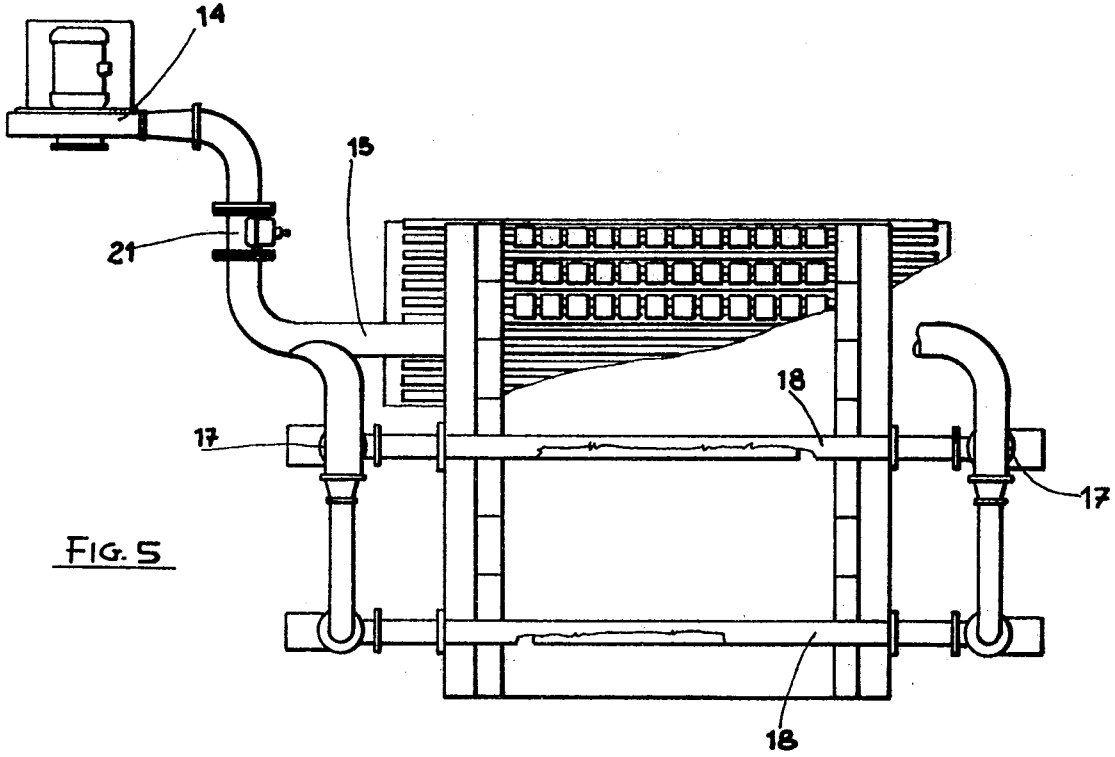
Figure 6:
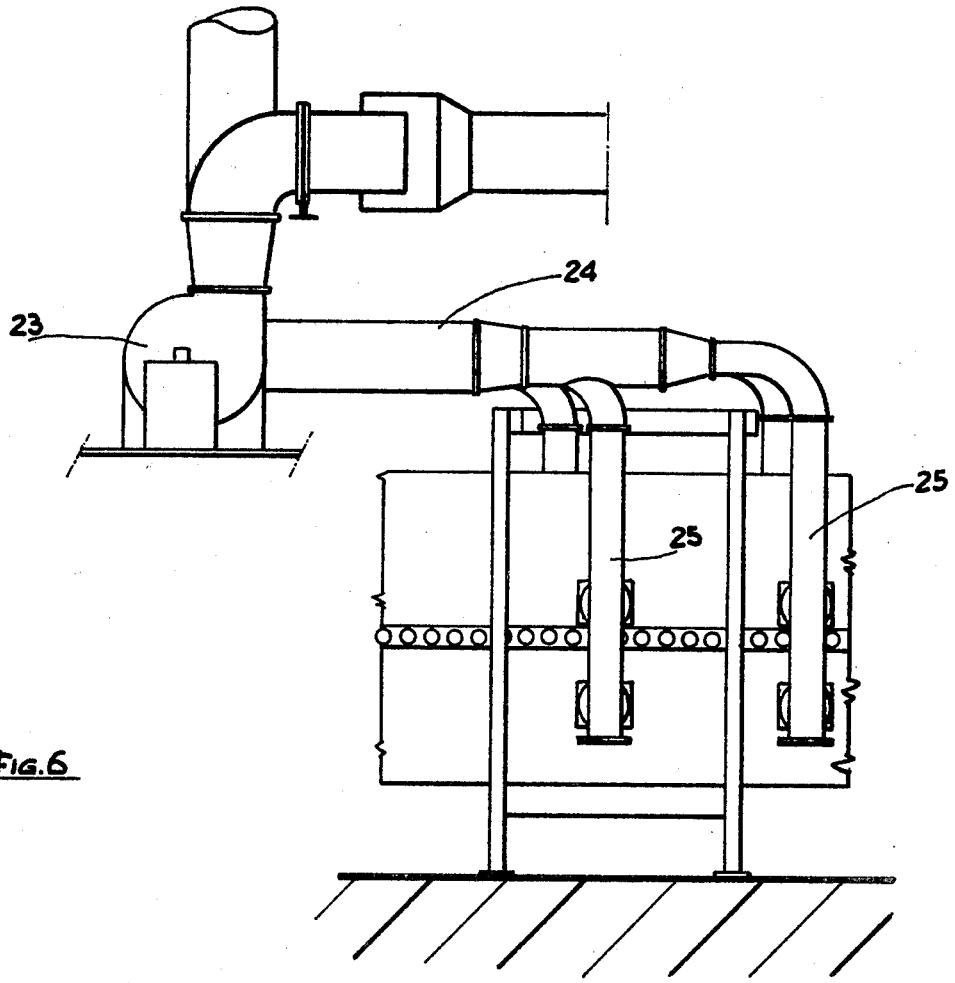
Figure 7:
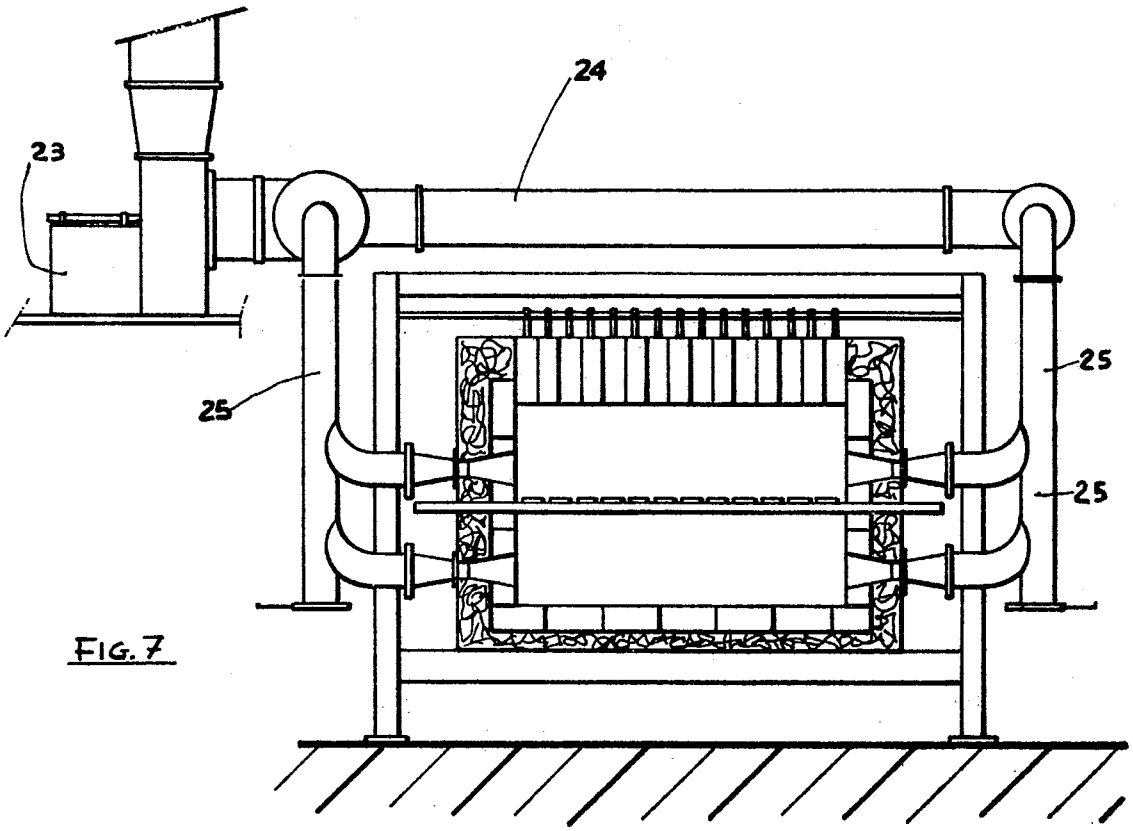

The cooling equipment of the section d-4 in accordance with the present invention includes (see FIGS. 2, 4 and 5) a cooling device designated in toto by the reference numeral 13. The device 13 includes a blower 14 supplying ambient air through a conduit 15 into the interior of the kiln 1. The conduit 15 is connected with a conduit 17 which has two branches on each side of the kiln 1. The conduit 17 is connected with two transverse conduits 18 which extend beyond and above the transport path 3 of the items 19. The conduits 18 have a longitudinal slit 20, through which the cooling air is discharged into the interior of the kiln 1. The direction of the stream of the cooling air can be adjusted so as to vary the degree of heat transfer to the cooling air, thus varying the time required for cooling the items in correspondence with the actual composition of the material of the items to be cooled. The air flow supplied by blower 14 can be adjusted by a remote controlled throttle 21. The cooling air upon entering the section d-4 tends to become heated due to contact of the same with the walls of the section, the hot items to be cooled, etc. The thus heated air passes to the section d-5, where the heated air is withdrawn by means of a suction device shown in toto by reference numeral 22 (see FIGS. 2, 6 and 7). The device 22 includes a blower 23 which serves to withdraw the heated gas from the interior of the section d-5 through a conduit 24 located above the kiln 1. The conduit 24 is connected to conduits 25 which communicate with the interior of the section d-5 through the side walls of the kiln 1.

The quantity of gas withdrawn is regulated by a remote controlled throttle 21 for the cooling device 13 which controls the position of throttle 26 as a function of the position of the throttle 21.

The fan 23 supplies the withdrawn gas through a conduit 27 partly into a discharge conduit 28 and partly through an elbow 29 and an adjustable air-lock 30, to a mixing arrangement 31 and further through a conduit 32 into a blower 33. The conduit 28 can be connected to a chimney or to any other recovery equipment which will be discussed in detail later on.

The blower 33 receives a portion of the withdrawn heated air and a portion of the fresh air supplied by the mixing arrangement 31, and supplies the thus formed mixture into the conduit 34 in the form of combustion air. The mixture is then supplied through the descending tubes 35 onto the burner distributed along the length of the section d-3.

The conduit 34 is located along the section d-3 and the section d-2. The part of the conduit 34 which runs along the section d-2 has a cross-sectional dimension smaller than that running along the section d-3 because of a diameter reduction 36. The section d-2 is supplied with the mixture through a plurality of tubes 37.

The initial portion of the kiln, namely at least the whole section d-1 (or a part of section d-2) is provided with a withdrawing conduit 38, which is operative to withdraw therethrough by means of conduits 39 the hot gas and supply the same into a prekiln 9. It is to be noted that the portion of the conduit 38 extending along the section d-2 may be separated from the remaining portion of the conduit 38 by an air valve (not shown) which is operative to connect or block the conduit 38. The withdrawn gas from the section d-1 may be also partially transported to a chimney 42 and partially through a bypass 43 and an air valve 44 into the prekiln 9 which is operative for supplementary preheating of the items before they enter the kiln 1.

The cooling device 13 and the suction arrangement 22 are interconnected with each other (see FIG. 2) so as to mutually influence each other with respect to the cooling air in the sections d-4 and d-5.

The air in the blower 33 instead of being mixed separately with the air supplied by the blower 23, can be heated by a heat exchanger (not shown), before the air reaches the discharge tube 28 (which can also be connected directly to the chimney) so that the blower 33 supplies fresh air and recovers at least a part of the heat, which otherwise would be lost through the conduit 28.

It is to be understood by now that at least a portion of the heat required for the upstream sections of the kiln is recovered from the kiln, instead of being supplied exclusively by the fuel or electrical heating equipment. Besides that, such an arrangement makes it possible to reach the required preheating and baking temperatures more easily and further to accelerate some treating steps, for example the preheating step. This fact leads to an increase in the productivity of the kiln, reducing the length of the kiln. This is very important with regard to reducing the cost of the kiln.

The embodiment shown in FIGS. 1, 2 and 3 is further provided with an arrangement for connecting the downstream sections of the kiln 1 with the upstream sections, for example with the preheating section d-2 so as to supply this section with the gas withdrawn from the downstream sections (thence having a relatively low temperature) to thereby keep the temperature of the preheating section below the maximum permissible degassing temperature. This arrangement includes a member 46, for example a blower, designed for treating gas at high temperature. The blower 46 is connected to the discharge conduit 28 of the suction device 22 of section d-5 by means of a conduit 47 with an air valve 48. The blower 46 is furthermore connected to a manifold 49 provided with a plurality of conduits 50 which communicate with the interior of the kiln baking section d-3.

The conduit 47 communicates with a conduit 56 through a valve 56'. The conduit 56 communicates through a plurality of tubes 57 with the interior of the cooling section 7. At least one tube 58 connects the conduit 56 with an outlet 59 of the device 10—11—12. It is to be mentioned that prior art kilns discharge the air heated on this section completely to atmosphere.

The outlet of the fan 46 is provided with a manifold 51 extending along the whole section d-2. The manifold 51 has a plurality of conduits 52 which connect the manifold 51 with the interior of the section d-2. Each conduit 52 is provided with an air valve 53 operative to regulate the air flow through the respective conduits 52.

Each conduit 52 enters the interior of the section d-2 in the space between two adjacent baffles 54. The baffles 54 are adjustably mounted on the upper wall of the kiln 1. By adjusting the height of the baffles 54 in the interior of the section d-2, it is possible to regulate the thickness of the gas layer embracing the items in the passage between the baffles 54 and corresponding baffles 55 mounted on the lower wall of the kiln. In accordance with the present invention the two successive sections d-2 and d-3 are separated from each other by two upper and lower double baffles 54 and 55. The two baffles 54 as well as the two baffles 55 define between each other a restricted chamber, into which it is possible to blow an air stream of appropriate temperature and pressure in order to avoid any mutual influence between the temperature regimes of these two neighboring sections.

Thus the blower 46 receives the gases from the section d-3, the section d-5 (through the air valve 48), the natural cooling section 7 and from the air compressor.

The hot flue gases of the section d-3 mixed with the air of the sections d-5 and d-7, said gases containing air with all oxygen percentage, are supplied to the manifold 51 to be then distributed into the interior of the section d-2. In this way a hot gas mixture is formed which has recovered the greater portion of the heat that, otherwise, would be lost out of the kiln, said mixture being very rich of oxygen and being in the best conditions, to contribute to the heating of the section d-2, saving much heating power (fuel or electric power) and to create an ambience rich of oxygen facilitating the combustion of the organic residues contained in the materials of the items.

It is clear that the hot gases in the section d-3 are prevented from directly entering the section d-2, thus the disadvantages discussed further above are eliminated. However, this hot gas is not wasted, but rather in controlled quantities fed back without exceeding the maximum permissible temperature in the section d-2.

The arrangement of the double-baffle separation chamber makes it possible to considerably increase the temperature of the baking section without affecting the temperature regime of the preheating section. Thus, for example the temperature differential between two sections may even be greater than 500° C. The same is true for the temperature differential between sections d-3 and d-4.

The hot gas can also be recovered upon its exiting the chimney 42 and used for other purposes, for example for drying the items before glazing. Although, the blower 46 supplies the heat-containing air, it is still preferable to additionally heat the section d-2 by conventional means.

It will be understood that each of the elements described above, or two or more together, may also find a useful application in other types of constructions differing from the types described above.

While the invention has been illustrated and described as embodied in a kiln, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A kiln for baking items progressively moving along the kiln, comprising a hollow elongated housing having an inlet and an outlet to receive and discharge the items to be treated, said housing including a preheating section, a baking section, a cooling section and a section for nature cooling, all successively located in said housing; means for introducing a cooling medium into said cooling section including a first blower and first regulating means connected to said first blower to control the amount of the cooling medium entering said cooling section, said introducing means being associated to a space in the cooling section immediately following said baking section to provide a substantial drop of the temperature of said items for accelerating the cooling process; means for withdrawing said medium as said medium is heated in heat exchange relationship with said items including first conduit means for receiving said withdrawn medium, second conduit means for receiving said withdrawn medium and ambient air from a supply source to be mixed with said medium to provide enriched combustion air, a second blower positioned between said first conduit means and said second conduit means and second regulating means connected to said second blower, said second regulating means being operatively connected to said first means to control the amount of medium to be withdrawn from said cooling section; means for connecting said second conduit means to said baking section for supplying the latter with enriched combustion air; third conduit means for receiving the gases from said section of natural cooling which gases are being heated in heat exchange relationship with said items to be cooled; connecting conduit means located between said withdrawing means and said third conduit means; discharging means connected to said baking section to withdraw hot gases therefrom, said discharging means being associated with said third conduit means; and means for mixing said hot gases from said discharging means and heated gases from said third conduit means; and means for drawing the mixture to said pre-heating section;

separating means to separate said sections one from another for preventing undersired mutual influence in different treating regimes and said separating means include sets of baffles mounted on an inner wall of said housing and located adjacent one to another so as to thermally separate each of two successive sections.

2. The kiln as defined in claim 1, wherein said means for introducing a cooling medium further include at least one conduit connected to said first blower and having a series of nozzles, and positioned in the interior of said cooling section adjacent to the travelling path of said items.

3. The kiln as defined in claim 2, wherein an additional conduit is provided, said conduit being connected to said first blower and having a series of nozzles, and positioned in the interior of said cooling section, said additional conduit being located adjacent to the travelling path of said items on the side opposite to location of said first mentioned conduit.

4. The kiln as defined in claim 1, wherein said connecting conduit means include valve means to vary the amount of mixture supplied into said baking section.

5. The kiln as defined in claim 1, wherein said discharging means connected to said baking section include a plurality of manifold conduits, positioned along said baking section.

6. The kiln as defined in claim 1, wherein said means for drawing said mixture include a plurality of manifold conduits to distribute the mixture along the length of said pre-heating section.

* * * * *